US008268520B2

(12) United States Patent
Wu et al.

(10) Patent No.: US 8,268,520 B2
(45) Date of Patent: Sep. 18, 2012

(54) POLYALKYLENE GLYCOL BENZOATE POLYTETRAFLUOROETHYLENE CONTAINING PHOTOCONDUCTORS

(75) Inventors: Jin Wu, Pittsford, NY (US); Kenny-Tuan T Dinh, Webster, NY (US); Linda L Ferrarese, Rochester, NY (US); Marc J Livecchi, Rochester, NY (US); Edward C Savage, Webster, NY (US); Michael E Zak, Canandaigua, NY (US)

(73) Assignee: Xerox Corporation, Norwalk, CT (US)

( * ) Notice: Subject to any disclaimer, the term of this patent is extended or adjusted under 35 U.S.C. 154(b) by 247 days.

(21) Appl. No.: 12/788,020

(22) Filed: May 26, 2010

(65) Prior Publication Data

US 2011/0294054 A1 Dec. 1, 2011

(51) Int. Cl.
*G03G 5/00* (2006.01)

(52) U.S. Cl. ..... 430/58.05; 430/58.35; 430/58.75

(58) Field of Classification Search ..... 430/58.05, 430/58.35, 58.75
See application file for complete search history.

(56) References Cited

U.S. PATENT DOCUMENTS

| | | | | |
|---|---|---|---|---|
| 5,473,064 | A | 12/1995 | Mayo et al. | |
| 5,482,811 | A | 1/1996 | Keoshkerian et al. | |
| 5,521,306 | A | 5/1996 | Burt et al. | |
| 6,913,863 | B2 | 7/2005 | Wu et al. | |
| 7,993,805 | B2 * | 8/2011 | Wu et al. | 430/58.8 |
| 2006/0105254 | A1 | 5/2006 | Wu et al. | |

OTHER PUBLICATIONS

Jin Wu et al., U.S. Appl. No. 12/644,071 on Polyalkylene Glycol Benzoate Containing Photoconductors, filed Dec. 22, 2009.
Jin Wu et al., U.S. Appl. No. 12/550,498 on Plasticizer Containing Photoconductors, filed Aug. 31, 2009.
Robert C.U. Yu et al., U.S. Appl. No. 12/471,311 on Flexible Imaging Members Having a Plasticized Imaging Layer, filed May 22, 2009.
Robert C.U. Yu et al., U.S. Appl. No. 12/434,572 on Flexible Imaging Members Without Anticurl Layer, filed May 1, 2009.

* cited by examiner

*Primary Examiner* — Mark A Chapman
(74) *Attorney, Agent, or Firm* — Eugene O. Palazzo

(57) ABSTRACT

A photoconductor that includes a supporting substrate, an optional ground plane layer, an optional hole blocking layer, an optional adhesive layer, a photogenerating layer, and at least one charge transport layer, and where the charge transport layer contains a polyalkylene glycol benzoate and a fluorinated polymer.

32 Claims, No Drawings

POLYALKYLENE GLYCOL BENZOATE POLYTETRAFLUOROETHYLENE CONTAINING PHOTOCONDUCTORS

CROSS REFERENCE TO RELATED APPLICATIONS

U.S. application Ser. No. 12/644,071, entitled Polyalkylene Glycol Benzoate Containing Photoconductors, filed Dec. 22, 2009, illustrates a photoconductor that includes a supporting substrate, an optional ground plane layer, an optional hole blocking layer, a photogenerating layer, and at least one charge transport layer, and where the charge transport layer contains a polyalkylene glycol benzoate.

U.S. application Ser. No. 12/550,498, entitled Plasticizer Containing Photoconductors, filed Aug. 31, 2009, illustrates a photoconductor comprising a substrate, a photogenerating layer, and a charge transport layer, and wherein the charge transport layer contains a cyclohexanedicarboxylate, such as diisononyl cyclohexanedicarboxylate.

U.S. application Ser. No. 12/471,311, entitled Flexible Imaging Members Having A Plasticized Imaging Layer, filed May 22, 2009, illustrates a flexible imaging member comprising a flexible substrate; a charge generating layer disposed on the substrate; and at least one charge transport layer disposed on the charge generating layer, wherein the charge transport layer comprises a polycarbonate, N,N'-diphenyl-N,N'-di(3-methylphenyl)-1, 1-biphenyl-4,4'-diamine, a first plasticizer or a second plasticizer, and further wherein the first plasticizer and the second plasticizer are miscible with both the polycarbonate and N,N'-diphenyl-N,N'-di(3-methylphenyl)-1,1-biphenyl-4, 4'-diamine.

U.S. application Ser. No. 12/434,572, entitled Flexible Imaging Members Without Anticurl Layer, filed May 1, 2009, illustrates a imaging member comprising a substrate; a charge generating layer disposed on the substrate; and at least one charge transport layer disposed on the charge generating layer, wherein the charge transport layer comprises a polycarbonate, a charge transport compound of N,N'-diphenyl-N,N'-bis(3-methylphenyl)-1, 1-biphenyl-4,4'-diamine, and a liquid compound having a high boiling point, and further wherein the liquid compound is miscible with both the polycarbonate and N,N'-diphenyl-N,N'-bis(3-methylphenyl)-1,1-biphenyl-4,4'-diamine.

Examples of plasticizers illustrated in the appropriate above copending applications are, for example, dioctyl phthalate, diallyl phthalate, liquid styrene dimer, and others as illustrated by the structure/formulas disclosed.

High photosensitivity titanyl phthalocyanines are illustrated in copending U.S. application Ser. No. 10/992,500, U.S. Publication No. 20060105254, entitled Processes for the Preparation of High Sensitivity Titanium Phthalocyanines Photogenerating Pigments, the disclosure of which are totally incorporated herein by reference, which, for example, discloses a process for the preparation of a Type V titanyl phthalocyanine, comprising providing a Type I titanyl phthalocyanine; dissolving the Type I titanyl phthalocyanine in a solution comprising a trihaloacetic acid and an alkylene halide like methylene chloride; adding the resulting mixture comprising the dissolved Type I titanyl phthalocyanine to a solution comprising an alcohol and an alkylene halide thereby precipitating a Type Y titanyl phthalocyanine; and treating the Type Y titanyl phthalocyanine with monochlorobenzene to yield a Type V titanyl phthalocyanine.

A number of the components of the above cross referenced applications, such as the appropriate supporting substrates, resin binders, antioxidants, charge transport components, titanyl phthalocyanines, high photosensitivity titanyl phthalocyanines, such as Type V, hydroxygallium phthalocyanines, or chlorogallium phthalocyanines, and an adhesive layer, and the like, may be selected for the photoconductors and imaging members of the present disclosure in embodiments thereof.

BACKGROUND

This disclosure is generally directed to layered imaging members, photoreceptors, photoconductors, and the like that can be selected for a number of systems, such as copiers and printers, especially xerographic copiers and printers inclusive of printers that generate color xerographic documents, and which printers can be selected for the office environment, and for production and commercial printing uses. More specifically, the present disclosure is directed to multilayered drums, or flexible belt imaging members or devices comprised of a supporting medium like a substrate; an optional ground plane layer; an optional hole blocking layer; a photogenerating layer; and a charge transport layer, including at least one or a plurality of charge transport layers, and wherein at least one charge transport layer is, for example, from 1 to about 7, from 1 to about 3, and one; and more specifically, a first charge transport layer and a second charge transport layer, and where a polyalkylene glycol benzoate, and yet more specifically, a polyalkylene glycol dibenzoate, and a fluorinated material, such as a polytetrafluoroethylene (PTFE) are present in a first pass charge transport layer that is in contact with the photogenerating layer. The polyalkylene glycol benzoate polytetrafluoroethylene containing photoconductors possess, in embodiments, excellent wear characteristics, and where the polyalkylene glycol benzoate functions, for example, as a charge transport layer (CTL) first or second resin binder, and the second or first binder is, for example, a polycarbonate.

Yet more specifically, an advantage of the photoconductors in embodiments of the present disclosure is that the wear rates when selecting for the charge transport layer a PTFE and a polyalkylene glycol benzoate additive was about 19 nanometers/kilocycle, about half of that of a PTFE charge transport layer (CTL) (with no polyalkylene glycol benzoate, a wear rate of about 31 nanometers/kilocycle), and about one fourth of that of a polyalkylene glycol benzoate CTL (with no PTFE, a wear rate of about 65 nanometers/kilocycle).

The photoconductors disclosed herein possess a number of advantages, such as, in embodiments, the minimal wearing of the charge transport layer or layers; the minimization or substantial elimination of undesirable ghosting on developed images, such as xerographic images, including decreased ghosting at various relative humidities; excellent cyclic and stable electrical properties; minimal charge deficient spots (CDS); compatibility with the photogenerating and charge transport resin binders; extended xerographic biased charge roller wear characteristics, and acceptable lateral charge migration (LCM) characteristics, such as for example, excellent LCM resistance.

Ghosting refers, for example, to when a photoconductor is selectively exposed to positive charges in a number of xerographic print engines, and where some of the positive charges enter the photoconductor and manifest themselves as a latent image in the subsequent printing cycles. This print defect can cause a change in the lightness of the half tones, and is commonly referred to as a "ghost" that is generated in the previous printing cycle. An example of a source of the positive charges is the stream of positive ions emitted from the transfer corotron. Since the paper sheets are situated between the transfer corotron and the photoconductor, the photoconductor is shielded from the positive ions from the paper sheets. In the areas between the paper sheets, the photoconductor is fully exposed, thus in this paper free zone the positive charges may enter the photoconductor. As a result, these charges cause a print defect or ghost in a half tone print if one switches to a larger paper format that covers the previous paper print free zone.

Excellent cyclic stability of the photoconductor refers, for example, to almost no or minimal change in a generated known photoinduced discharge curve (PIDC), especially no or minimal residual potential cycle up after a number of charge/discharge cycles of the photoconductor, for example about 100 kilocycles, or xerographic prints of, for example, from about 80 to about 100 kiloprints. Excellent color print stability refers, for example, to substantially no or minimal change in solid area density, especially in 60 percent halftone prints, and no or minimal random color variability from print to print after a number of xerographic prints, for example 50 kiloprints.

Also included within the scope of the present disclosure are methods of imaging and printing with the photoconductor devices illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697 and 4,338,390, the disclosures of which are totally incorporated herein by reference, subsequently transferring the toner image to a suitable image receiving substrate, and permanently affixing the image thereto. In those environments wherein the photoconductor is to be used in a printing mode, the imaging method involves the same operation with the exception that exposure can be accomplished with a laser device or image bar. More specifically, the flexible photoconductor belts disclosed herein can be selected for the Xerox Corporation iGEN® machines that generate with some versions over 100 copies per minute. Processes of imaging, especially xerographic imaging and printing, including digital and/or color printing, are thus encompassed by the present disclosure. The imaging members are, in embodiments, sensitive in the wavelength region of, for example, from about 400 to about 900 nanometers, and in particular from about 650 to about 850 nanometers, thus diode lasers can be selected as the light source. Moreover, the imaging members of this disclosure are useful in color xerographic applications, particularly high-speed color copying and printing processes.

REFERENCES

There is illustrated in U.S. Pat. No. 6,913,863 a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

A number of layered photoconductors are known and have been described in numerous U.S. patents, and which patents disclose, for example, a photoconductor comprised of a supporting substrate, a photogenerating layer, and a charge transport layer, and where the photogenerating layer and charge transport layer include certain resin binders, such as polycarbonates, polyesters, and the like.

Illustrated in U.S. Pat. No. 5,521,306 is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811 is a process for the preparation of hydroxygallium phthalocyanine photogenerating pigments which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water, concentrating the resulting aqueous slurry comprised of water and hydroxygallium phthalocyanine to a wet cake; removing water from the slurry by azeotropic distillation with an organic solvent, and subjecting the resulting pigment slurry to mixing with the addition of a second solvent to cause the formation of the hydroxygallium phthalocyanine polymorphs.

Also, in U.S. Pat. No. 5,473,064 there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, hydrolyzing the pigment precursor chlorogallium phthalocyanine Type I by standard methods, for example acid pasting, subsequently treating the resulting hydrolyzed pigment hydroxygallium phthalocyanine Type I with a solvent, such as N,N-dimethylformamide, present in an amount of from about 1 to about 50 volume parts, and preferably about 15 volume parts for each weight part of pigment hydroxygallium phthalocyanine that is used by, for example, ball milling the Type I hydroxygallium phthalocyanine pigment in the presence of spherical glass beads, approximately 1 to 5 millimeters in diameter, at room temperature, about 25° C., for a period of from about 12 hours to about 1 week, and more specifically about 24 hours.

The appropriate components, such as the supporting substrates, the photogenerating layer components, the charge transport layer components, the overcoating layer components, and the like, of the above-recited patents may be selected for the photoconductors of the present disclosure in embodiments thereof.

EMBODIMENTS

Aspects of the present disclosure relate to a photoconductor comprising a supporting substrate, a photogenerating layer, and a charge transport layer, and wherein the charge transport layer contains a polyalkylene glycol benzoate and a fluorinated polymer; a photoconductor comprised of a supporting substrate, a hole blocking layer thereover, a photogenerating layer, and a charge transport layer, and wherein the charge transport layer contains a polyalkylene glycol benzoate present in an amount of from about 1 to about 12 weight percent, and a polytetrafluoroethylene present in an amount of from about 2 to about 10 weight percent; a photoconductor comprised in sequence of a photogenerating layer comprised of a photogenerating pigment, a hole blocking layer, an adhesive layer, and a charge transport layer, and wherein the charge transport layer is comprised of a charge transport component, a resin binder, a polyalkylene glycol benzoate and a fluorinated polymer selected from the group consisting of polytetrafluoroethylene, a copolymer of tetrafluoroethylene and hexafluoropropylene, a copolymer of tetrafluoroethylene and perfluoro(propylvinyl ether), a copolymer of tetrafluoroethylene and perfluoro(ethyl vinyl ether), a copolymer of tetrafluoroethylene and perfluoro(methyl vinyl ether), and a copolymer of tetrafluoroethylene, hexafluoropropylene and vinylidene fluoride; a photoconductor comprising a substrate, a photogenerating layer, and a charge transport layer, and wherein the charge transport layer contains a charge transport component, such as an aryl amine and other know charge and hole transport components, a resin binder, a fluorinated polymer, such as a polytetrafluoroethylene (PTFE) and a polyalkylene glycol benzoate; a photoconductor comprising a substrate, an undercoat layer thereover, a photogenerating layer, and at least one charge transport layer, and wherein the at least one charge transport layer in contact with the photogenerating layer contains a polyalkylene glycol benzoate present in an amount of from about 1 to about 25 weight percent, from 2 to about 20 weight percent, from about 4 to about 15 weight percent, and more specifically about 10 weight percent, and a fluorinated polymer such as a PTFE present in an amount of for example, from about 2 to about 20 weight percent, from about 4 to about 15 weight percent, from about 6 to about 10 weight percent, and more specifically about 8 weight percent; a photoconductor comprised in sequence of a photogenerating layer comprised of a photogenerating pigment, and a hole transport layer, and wherein the transport layer is comprised of a hole transport component, a fluorinated polymer, such as a polytetrafluoroethylene (PTFE) and a polyalkylene glycol dibenzoate; a photoconductor comprising a supporting substrate, a ground plane layer, a hole blocking layer, a photogenerating layer comprised of at least one photogenerating pigment, and at least one charge transport layer comprised of at least one charge transport component, and where the charge transport layer has incorporated therein a polyalkylene glycol dibenzoate obtainable, for example, as UNIPLEX® 284, UNIPLEX® 400, and UNIPLEX® 988, obtainable from Unitex Chemical Corporation, and a fluorinated polymer, and more specifically, where the fluorinated polymer is a PTFE obtainable, for example, as POLYFLON™ L-2 and L-5 from Daikin Industries; a flexible photoconductive member comprised in sequence of a supporting substrate, a ground plane layer, a hole blocking or undercoat layer, a photogenerating layer thereover comprised of at least one photogenerating pigment, and as a second binder for the charge transport layer a polyalkylene glycol benzoate, and as a lubricant for the charge transport layer a PTFE; a photoconductor which includes a hole blocking layer and an adhesive layer where the adhesive layer is situated between the hole blocking layer and the photogenerating layer, and the hole blocking layer is situated between the supporting substrate layer, and the adhesive layer; a photoconductor comprising a supporting substrate, a hole blocking layer, a photogenerating layer, and at least one charge transport layer comprised of at least one charge transport component, and wherein the first charge transport layer is in contact with the photogenerating layer, the second pass charge transport layer is in contact with the first charge transport layer, and the second top charge transport layer includes therein a polyalkylene glycol benzoate and a PTFE, a hole transport component, and a resin binder; a photoconductor comprising a supporting substrate, a photogenerating layer in contact with the supporting substrate, and at least one charge transport layer in contact with the photogenerating layer, and wherein at least one, such as 1, 2, or 3 charge transport layers, contains a polyalkylene glycol benzoate as illustrated herein, and a fluorinated polymer, such as PTFE; a photoconductor comprised in sequence of a photogenerating layer comprised of a photogenerating pigment, such as a hydroxygallium phthalocyanine, a chlorogallium phthalocyanine or a titanyl phthalocyanine, a first charge transport layer, and a second charge transport layer thereover, and wherein the second charge transport layer is comprised of a charge transport component, a resin binder, a polytetrafluoroethylene and a polyalkylene glycol dibenzoate, wherein alkylene contains, for example, from 1 to about 12 carbon atoms, from 1 to about 8 carbon atoms, from 1 to about 4 carbon atoms, and more specifically, where the polyalkylene is a polypropylene.

The photoconductors disclosed herein, in embodiments, include in the charge transport layer a polyalkylene glycol benzoate as represented by

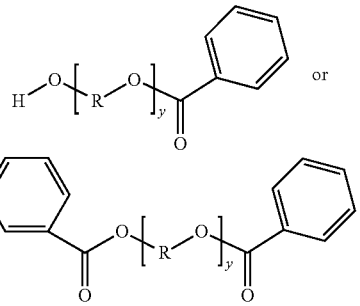

wherein R is alkylene as illustrated herein, and, for example, contains from 1 to about 12 carbon atoms, from 2 to about 10 carbon atoms, from 2 to about 6 carbon atoms, and more specifically, 1, 2, 3, 4, 5, or 6 carbon atoms, such as methylene, ethylene, propylene, butylene, pentylene, hexylene, and the like; y represents the number of repeating units of the alkylene glycol, and where y is, for example, from about 1 to about 50, from about 1 to about 20, or from about 1 to about 6.

The polyalkylene glycol benzoate possesses, for example, a number average molecular weight ($M_n$) of from about 150 to about 10,000, or from about 200 to about 1,000, and a weight average molecular weight ($M_w$) of from about 200 to about 20,000, or from about 300 to about 2,000 where $M_w$ and $M_n$ were determined by Gel Permeation Chromatography (GPC).

Examples of polyalkylene glycol benzoates present in the charge transport layer in effective amounts, such as from about 0.1 to about 20 weight percent, are a polypropylene glycol benzoate and dibenzoate, a polyethylene glycol benzoate and dibenzoate, a polybutylene glycol benzoate and dibenzoate, a polypentylene glycol benzoate and dibenzoate, a polyhexylene glycol benzoate and dibenzoate, a polyheptylene glycol benzoate and dibenzoate, a polyoctylene glycol benzoate and dibenzoate, a polynonylene glycol benzoate and dibenzoate, a polydecylene glycol benzoate and dibenzoate, and their copolymers, and mixtures thereof.

Specific examples of polyalkylene glycol benzoates are polypropylene glycol dibenzoates represented by the following where it is known that the dangling bond with no substituent is an alkyl, such as a methyl group,

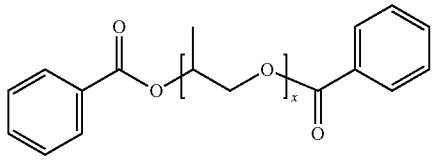

and which is available as UNIPLEX® 400 (x=3); UNIPLEX® 988 (x=2); and UNIPLEX® 284 (x=1), all available from Unitex Chemical Corporation.

Examples of the fluorinated polymer included in the charge transport layer are polytetrafluoroethylene (PTFE), a copolymer of tetrafluoroethylene and hexafluoropropylene, a copolymer of tetrafluoroethylene and perfluoro(propyl vinyl ether), a copolymer of tetrafluoroethylene and perfluoro(ethyl vinyl ether), a copolymer of tetrafluoroethylene and perfluoro(methyl vinyl ether), and a copolymer of tetrafluoroethylene, hexafluoropropylene and vinylidene fluoride, mixtures thereof, and the like, inclusive of a number of suitable known fluorinated polymers.

In embodiments, the fluorinated polymers are nanosized/micronsized particles with a diameter of, for example, from about 200 nanometers to about 10 microns, or from about 400 nanometers to about 3 microns. Specific fluorinated polymer examples are PTFE POLYFLON™ L-2 (average particle diameter size of about 3 microns), L-5 (average particle diameter size of about 5 microns), L-5F (average particle size of about 4 microns), LDW-410 (average particle size of about 0.2 micron), all commercially available from Daikin Industries, Ltd., Japan; and PTFE NANOFLON® P51A (average particle size about 0.3 micron), all commercially available from Shamrock Technologies, N.J., USA.

PHOTOCONDUCTOR LAYER EXAMPLES

A number of known components can be selected for the various photoconductor layers, such as the supporting substrate, the photogenerating layer, the charge transport layer, the hole blocking layer when present, and the adhesive layer when present, such as those components as illustrated in the copending applications referenced herein.

The thickness of the photoconductor substrate layer depends on many factors, including economical considerations, electrical characteristics, adequate flexibility, availability, and cost of the specific components for each layer, and the like, thus this layer may be of a substantial thickness, for example about 3,000 microns, such as from about 1,000 to about 2,000 microns, from about 500 to about 1,000 microns, or from about 300 to about 700 microns ("about" throughout includes all values in between the values recited), or of a minimum thickness. In embodiments, the thickness of this layer is from about 75 to about 300 microns, or from about 100 to about 150 microns.

The photoconductor substrate may be opaque or substantially transparent, and may comprise any suitable material including known or future developed materials. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, gold, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired, and economical considerations. For a drum, this layer may be of a substantial thickness of, for example, up to many centimeters or of a minimum thickness of less than a millimeter. Similarly, a flexible belt may be of a substantial thickness of, for example, about 250 microns, or of a minimum thickness of less than about 50 microns provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, supporting substrate layers selected for the photoconductors of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

Examples of electrically conductive layers or ground plane layers usually present on nonconductive substrates are gold, gold containing compounds, aluminum, titanium, titanium/zirconium, and other known suitable components. The thickness of the metallic ground plane is, for example, from about 10 to about 100 nanometers, from about 20 to about 50 nanometers, and more specifically, about 35 nanometers, and the titanium or titanium/zirconium ground plane is, for example, from about 10 to about 30 nanometers, and more specifically, about 20 nanometers in thickness.

An optional hole blocking layer, when present, is usually in contact with the ground plane, and can be comprised of a number of known components as illustrated herein, such as metal oxides, phenolic resins, aminosilanes, mixtures thereof, and the like.

Aminosilane examples included in the hole blocking layer can be represented by

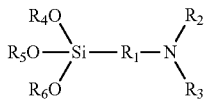

wherein $R_1$ is an alkylene group containing, for example, from 1 to about 25 carbon atoms; $R_2$ and $R_3$ are independently selected from the group consisting of at least one of hydrogen or alkyl containing, for example, from 1 to about 12 carbon atoms, and more specifically, from 1 to about 4 carbon atoms; aryl with, for example, from about 6 to about 42 carbon atoms, such as a phenyl group; and a poly(alkylene like ethylene amino) group; and $R_4$, $R_5$ and $R_6$ are independently selected from an alkyl group containing, for example, from 1 to about 10 carbon atoms, and more specifically, from 1 to about 4 carbon atoms.

Aminosilane specific examples include 3-aminopropyl triethoxysilane, N,N-dimethyl-3-aminopropyl triethoxysilane, N-phenylaminopropyl trimethoxysilane, triethoxysilylpropylethylene diamine, trimethoxysilylpropylethylene diamine, trimethoxysilylpropyldiethylene triamine, N-aminoethyl-3-aminopropyl trimethoxysilane, N-2-aminoethyl-3-aminopropyl trimethoxysilane, N-2-aminoethyl-3-aminopropyl tris(ethylethoxy)silane, p-aminophenyl trimethoxysilane, N,N'-dimethyl-3-aminopropyl triethoxysilane, 3-aminopropylmethyl diethoxysilane, 3-aminopropyl trimethoxysilane, N-methylaminopropyl triethoxysilane, methyl[2-(3-trimethoxysilylpropylamino)ethylamino]-3-proprionate, (N,N'-dimethyl 3-amino)propyl triethoxysilane, N,N-dimethylaminophenyl triethoxysilane, trimethoxysilyl propyldiethylene triamine, and the like, and mixtures thereof. Yet more specific aminosilane materials are 3-aminopropyl triethoxysilane (γ-APS), N-aminoethyl-3-aminopropyl trimethoxysilane, (N,N'-dimethyl-3-amino)propyl triethoxysilane, and mixtures thereof.

The aminosilane may be hydrolyzed to form a hydrolyzed silane solution before being added into the final undercoat coating solution or dispersion. During hydrolysis of the aminosilanes, the hydrolyzable groups, such as alkoxy groups, are replaced with hydroxyl groups. The pH of the hydrolyzed silane solution can be controlled to obtain excellent characteristics on curing, and to result in electrical stability. A solution pH of, for example, from about 4 to about 10 can be selected, and more specifically, a pH of from about 7 to about 8. Control of the pH of the hydrolyzed silane solution may be affected with any suitable material, such as generally organic or inorganic acids. Typical organic and inorganic acids include acetic acid, citric acid, formic acid, hydrogen iodide, phosphoric acid, hydrofluorosilicic acid, p-toluene sulfonic acid, and the like.

The hole blocking layer can, in embodiments, be prepared by a number of known methods, the process parameters being dependent, for example, on the photoconductor member desired. The hole blocking layer can be coated as a solution or a dispersion onto the supporting substrate or on to the ground plane layer by the use of a spray coater, dip coater, extrusion coater, roller coater, wire-bar coater, slot coater, doctor blade coater, gravure coater, and the like, and dried at from about 40° C. to about 200° C. for a suitable period of time, such as from about 1 minute to about 10 hours, under stationary conditions or in an air flow. The coating can be accomplished to provide a final coating thickness of, for example, from about 0.01 to about 30 microns, or from about 0.02 to about 5 microns, or from about 0.03 to about 0.5 micron after drying.

Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo) perylene, titanyl phthalocyanines, and the like, and more specifically, vanadyl phthalocyanines, Type V hydroxygallium phthalocyanines, high sensitivity titanyl phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers, and the amount of photogenerating material contained in the photogenerating layer. Accordingly, this layer can be of a thickness of, for example, from about 0.05 to about 10 microns, and more specifically, from about 0.25 to about 2 microns when, for example, the photogenerating compositions are present in an amount of from about 30 to about 75 percent by volume. The maximum thickness of this layer, in embodiments, is dependent primarily upon factors, such as photosensitivity, electrical properties, and mechanical considerations.

The photogenerating composition or pigment can be present in a resinous binder composition in various amounts inclusive of up to 100 percent by weight. Generally, however, from about 5 to about 95 percent by volume of the photogenerating pigment is dispersed in about 95 to about 5 percent by volume of the resinous binder, or from about 20 to about 30 percent by volume of the photogenerating pigment is dispersed in about 70 to about 80 percent by volume of the resinous binder composition. In one embodiment, about 90 percent by volume of the photogenerating pigment is dispersed in about 10 percent by volume of the resinous binder composition, and which resin may be selected from a number of known polymers, such as poly(vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly (vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium, and the like, hydrogenated amorphous silicon and compounds of silicon and germanium, carbon, oxygen, nitrogen, and the like fabricated by vacuum evaporation or deposition. The photogenerating layer may also comprise inorganic pigments of crystalline selenium and its alloys; Groups II to VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos, and the like dispersed in a film forming polymeric binder, and fabricated by solvent coating techniques.

In embodiments, examples of polymeric binder materials that can be selected as the matrix or binder for the photogenerating layer are thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly (phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene, acrylonitrile copolymers, poly(vinyl chloride), vinyl chloride and vinyl acetate copolymers, acrylate copolymers, alkyd resins, cellulosic film formers, poly(amideimide), styrene butadiene copolymers, vinylidene chloride-vinyl chloride copolymers, vinyl acetate-vinylidene chloride copolymers, styrene-alkyd resins, poly(vinyl carbazole), and the like. These polymers may be block, random, or alternating copolymers.

Various suitable and conventional known processes may be used to mix, and thereafter apply the photogenerating layer coating mixture like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like.

The final dry thickness of the photogenerating layer is as illustrated herein, and can be, for example, from about 0.01 to about 30 microns after being dried at, for example, about 40° C. to about 150° C. for about 15 to about 90 minutes. More specifically, a photogenerating layer of a thickness, for example, of from about 0.1 to about 10 microns, or from about 0.2 to about 2 microns can be applied to or deposited on a supporting substrate, or on other surfaces in between the substrate and the charge transport layer, and the like. A charge blocking layer or hole blocking layer may optionally be applied to the electrically conductive supporting substrate surface prior to the application of a photogenerating layer. When desired, an adhesive layer may be included between the charge blocking, hole blocking layer or interfacial layer, and the photogenerating layer. Usually, the photogenerating layer is applied onto the blocking layer, and a charge transport layer or plurality of charge transport layers is formed on the photogenerating layer. This structure may have the photogenerating layer on top of or below the charge transport layer.

In embodiments, a suitable known adhesive layer can be included in the photoconductor. Typical adhesive layer materials include, for example, polyesters, polyurethanes, and the like. The adhesive layer thickness can vary, and in embodiments is, for example, from about 0.05 to about 0.3 micron. The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As an optional adhesive layer or layers usually in contact with or situated between the hole blocking layer and the photogenerating layer, there can be selected various known substances inclusive of copolyesters, polyamides, poly(vinyl butyral), poly(vinyl alcohol), polyurethane, and polyacrylonitrile. This layer is, for example, of a thickness of from about 0.001 to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

A number of charge transport compounds can be included in the charge transport layer, which layer generally is of a thickness of from about 5 to about 75 microns, and more specifically, of a thickness of from about 10 to about 40 microns. Examples of charge transport components are aryl amines of the following formulas/structures

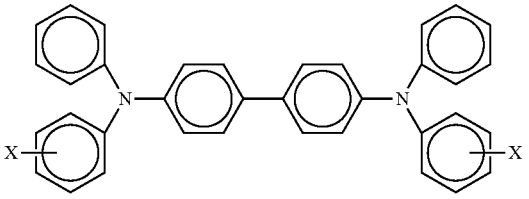

and

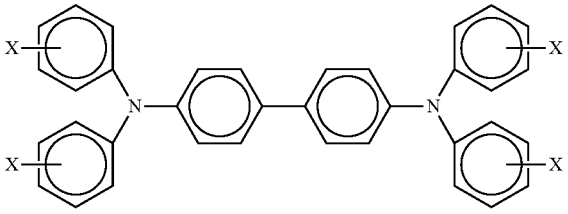

wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

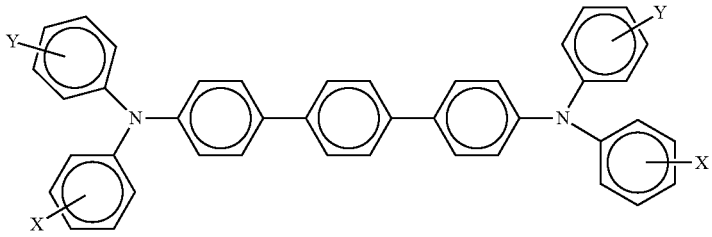

and

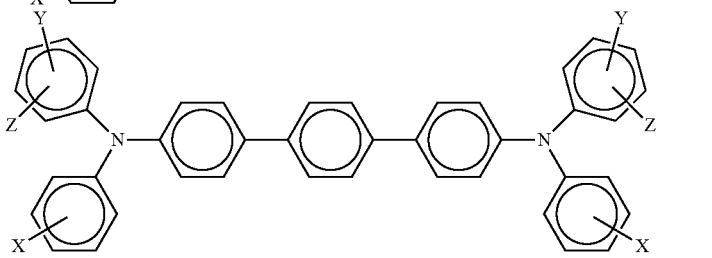

wherein X, Y and Z are independently alkyl, alkoxy, aryl, a halogen, or mixtures thereof, and wherein at least one of Y and Z are present.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines that can be selected for the charge transport layer include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules can be selected, reference for example, U.S. Pat. Nos. 4,921,773 and 4,464,450, the disclosures of which are totally incorporated herein by reference.

Examples of binder materials in addition to the compatible polyalkylene glycol benzoate selected for the charge transport layers include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly(4,4'-isopropylidene-diphenylene)carbonate (also referred to as bisphenol-A-polycarbonate), poly(4,4'-cyclohexylidine diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000. Generally, the transport layer contains from about 10 to about 75 percent by weight of the charge transport material, and more specifically, from about 35 to about 50 percent of this material.

The charge transport layer or layers, and more specifically, a first charge transport in contact with the photogenerating layer, and thereover a top or second charge transport overcoating layer, may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of hole transporting molecules present, for example, in an amount of from about 50 to about 75 weight percent, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N-methyl-3-(9-ethyl) carbazyl hydrazone and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. However, in embodiments, to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency, and transports them across the charge transport layer with short transit times includes N,N'-diphenyl-N,N'-bis(3-methylphenyl)-(1,1'-biphenyl)-4,4'-diamine, N,N'-bis(4-butylphenyl)-N,N'-di-p-tolyl[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, or mixtures thereof. If desired, the charge transport material in the charge transport layer may comprise a polymeric charge transport material, or a combination of a small molecule charge transport material and a polymeric charge transport material.

Examples of components or materials optionally incorporated into the charge transport layers, or at least one charge transport layer to, for example, enable excellent lateral charge migration (LCM) resistance include hindered phenolic antioxidants, such as tetrakis methylene(3,5-di-tert-butyl-4-hydroxy hydrocinnamate)methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl) phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0 to about 20 weight percent, from about 1 to about 10 weight percent, or from about 3 to about 8 weight percent.

A number of processes may be used to mix, and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each of the charge transport layers, in embodiments, is from about 10 to about 70 microns, but thicknesses outside this range may, in embodiments, also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported to selectively discharge a surface charge present on the surface of the photoconductor. Typical application techniques include spraying, dip coating, roll coating, wire wound rod coating, and the like. Drying of the deposited coating may be effected by any suitable conventional technique, such as oven drying, infrared radiation drying, air drying, and the like. A known optional overcoating may be applied over the charge transport layer to provide abrasion protection.

In embodiments, the present disclosure relates to a photoconductive imaging member comprised of a titanium/zirconium containing ground plane layer, a hole blocking layer, a photogenerating layer, a polyalkylene glycol benzoate containing charge transport layer, and an overcoating charge transport layer; a photoconductive member with a photogenerating layer of a thickness of from about 0.1 to about 8 microns, and at least one transport layer each of a thickness of from about 5 to about 100 microns; an imaging method and an imaging apparatus containing a charging component, a development component, a transfer component, and a fixing component, and wherein the apparatus contains a photoconductive imaging member comprised of a supporting substrate, a ground plane layer, a hole blocking layer, and thereover a photogenerating layer comprised of a photogenerating pigment, and a charge transport layer or layers, and thereover an overcoating charge transport layer, and where the transport layer is of a thickness of from about 40 to about 75 microns; a member wherein the photogenerating layer contains a photogenerating pigment present in an amount of from about 8 to about 95 weight percent; a member wherein the thickness of the photogenerating layer is from about 0.1 to about 4 microns; a member wherein the photogenerating layer contains a polymer binder; a member wherein the binder is present in an amount of from about 50 to about 90 percent by weight, and wherein the total of all layer components is about 100 percent; a member wherein the photogenerating component is a titanyl phthalocyanine or a hydroxygallium phthalocyanine that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate, aluminized polyethylene naphthalate, titanized polyethylene terephthalate, titanized polyethylene naphthalate, titanized/zirconized polyethylene terephthalate, titanized/zirconized polyethylene naphthalate, goldized polyethylene terephthalate, or goldized polyethylene naphthalate; an imaging member wherein the photogenerating resinous binder is selected from the group consisting of polyesters, polyvinyl butyrals, polycarbonates, polystyrene-b-polyvinyl pyridine, and polyvinyl formals; an imaging member wherein the photogenerating pigment is a metal free phthalocyanine; an imaging member wherein each of the charge transport layers comprises

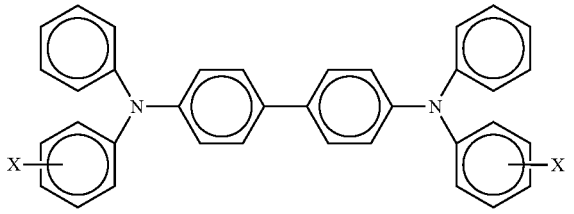

wherein X is selected from the group consisting of alkyl, alkoxy, aryl, and halogen; an imaging member wherein alkyl and alkoxy contains from about 1 to about 12 carbon atoms; an imaging member wherein alkyl contains from about 1 to about 5 carbon atoms; an imaging member wherein alkyl is methyl; an imaging member wherein each of, or at least one of the charge transport layers comprises

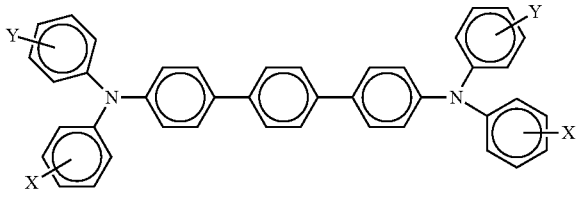

wherein X and Y are independently alkyl, alkoxy, aryl, a halogen, or mixtures thereof; an imaging member wherein alkyl and alkoxy for the charge transport component aryl amine contain from about 1 to about 12 carbon atoms; an imaging member wherein alkyl contains from about 1 to about 5 carbon atoms, and wherein the resinous binder is selected from the group consisting of polycarbonates and polystyrene; an imaging member wherein the photogenerating pigment present in the photogenerating layer is comprised of chlorogallium phthalocyanine, or Type V hydroxygallium phthalocyanine prepared by hydrolyzing a gallium phthalocyanine precursor by dissolving the hydroxygallium phthalocyanine in a strong acid, and then reprecipitating the resulting dissolved precursor in a basic aqueous media; removing any ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, at Bragg angles (2 theta +/−0.2°) 7.4, 9.8, 12.4, 16.2, 17.6, 18.4, 21.9, 23.9, 25.0, 28.1 degrees, and the highest peak at 7.4 degrees; a method of imaging which comprises generating an electrostatic latent image on an imaging member developing the latent image, and transferring the developed electrostatic image to a suitable substrate; a method of imaging wherein the imaging member is exposed to light of a wavelength of from about 370 to about 950 nanometers; a photoconductive member wherein the photogenerating layer is situated between the substrate and the charge transport; a member wherein the charge transport layer is situated between the substrate and the photogenerating layer; a member wherein the photogenerating layer is of a thickness of from about 0.1 to about 50 microns; a member wherein the photogenerating pigment is dispersed in from about 1 weight percent to about 80 weight percent of a polymer binder; a member wherein the binder is present in an amount of from about 50 to about 90 percent by weight, and wherein the total of the layer components is about 100 percent; an imaging member wherein the photogenerating component is Type V hydroxygallium phthalocyanine, Type V titanyl phthalocyanine or chlorogallium phthalocyanine, and the charge transport layer contains a hole transport of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine molecules, and wherein the hole transport resinous binder is selected from the group consisting of polycarbonates and polystyrene; an imaging member wherein the photogenerating layer contains a metal free phthalocyanine; a photoconductor wherein the photogenerating layer contains an alkoxygallium phthalocyanine; photoconductive imaging members comprised of a supporting substrate, a photogenerating layer, a hole transport layer, and in embodiments wherein a plurality of charge transport layers are selected, such as for example, from two to about ten, and more specifically two, may be selected; and a photoconductive imaging member comprised of an optional supporting substrate, a photogenerating layer, and a first, second, and third charge transport layer.

In embodiments, the charge transport component can be represented by the following formulas/structures

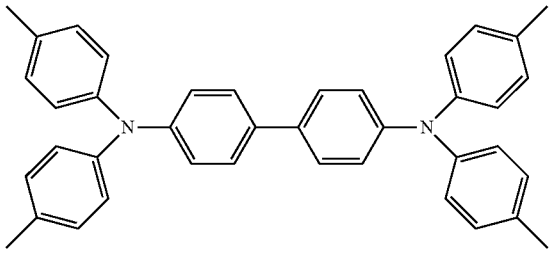

;

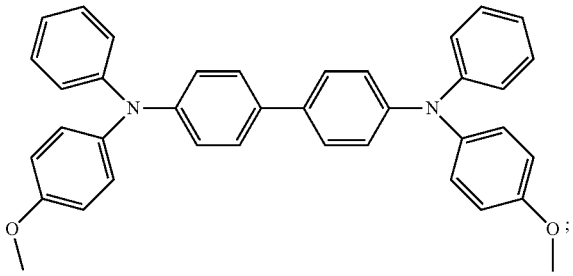

;

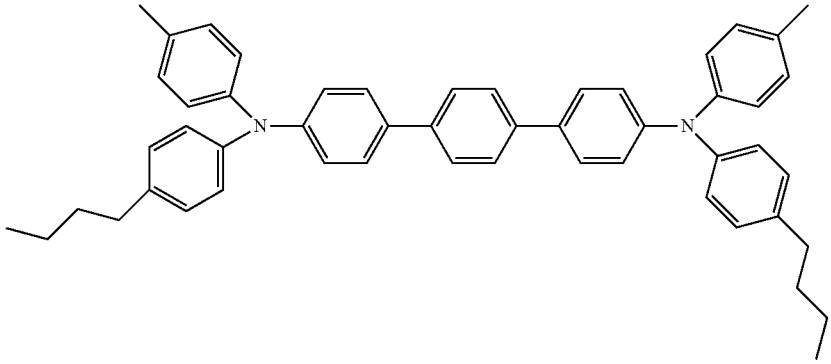

;

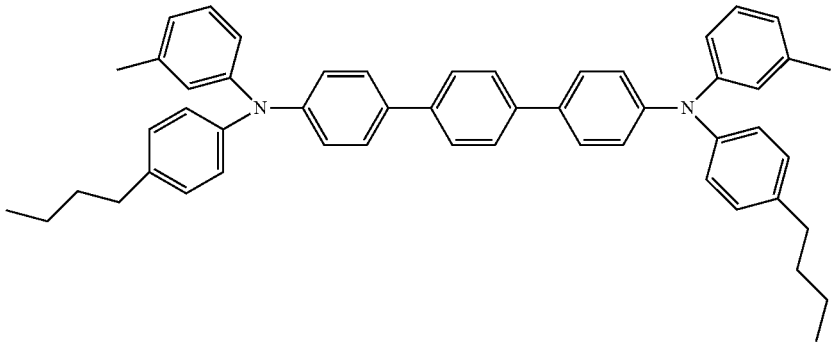

and

-continued

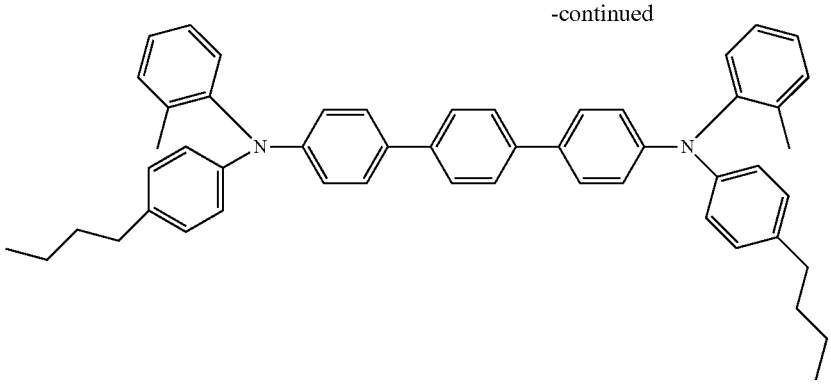

The following Examples are being submitted to illustrate embodiments of the present disclosure. Molecular weights were determined by Gel Permeation analysis.

COMPARATIVE EXAMPLE 1

On a 30 millimeter thick aluminum drum substrate, an undercoat layer was prepared and deposited thereon as follows.

Zirconium acetylacetonate tributoxide (35.5 parts), y-aminopropyl triethoxysilane (4.8 parts), and poly(vinyl butyral) BM-S (2.5 parts) were dissolved in n-butanol (52.2 parts). The resulting solution was then coated by a dip coater on the above aluminum drum substrate, and the coating solution layer was pre-heated at 59° C. for 13 minutes, humidified at 58° C. (dew point=54° C.) for 17 minutes, and dried at 135° C. for 8 minutes. The thickness of the resulting undercoat layer was approximately 1.3 microns.

A photogenerating layer, 0.2 micron in thickness, comprising chlorogallium phthalocyanine (Type C) was deposited on the above undercoat layer. The photogenerating layer coating dispersion was prepared as follows. 2.7 Grams of chlorogallium phthalocyanine (ClGaPc) Type C pigment were mixed with 2.3 grams of the polymeric binder (carboxyl-modified vinyl copolymer, VMCH, available from Dow Chemical Company), 15 grams of n-butyl acetate, and 30 grams of xylene. The resulting mixture was mixed in an Attritor mill with about 200 grams of 1 millimeter Hi-Bea borosilicate glass beads for about 3 hours. The dispersion mixture obtained was then filtered through a 20 micron Nylon cloth filter, and the solids content of the dispersion was diluted to about 6 weight percent.

Subsequently, a 32 micron charge transport layer was coated on top of the above photogenerating layer from a solution prepared by dissolving N,N'-diphenyl-N,N-bis(3-methylphenyl)-1,1'-biphenyl-4,4'-diamine (mTBD, 4 grams), and a film forming polymer binder PCZ-400 [poly(4,4'-dihydroxy-diphenyl-1-1-cyclohexane, $M_w$=40,000)] available from Mitsubishi Gas Chemical Company, Ltd. (6 grams) in a solvent mixture of 21 grams of tetrahydrofuran (THF), and 9 grams of toluene, followed by drying in an oven at about 120° C. for about 40 minutes. The resulting charge transport layer PCZ-400/mTBD ratio was 60/40.

COMPARATIVE EXAMPLE 2

A photoconductor was prepared by repeating the process of Comparative Example 1 except that the 32 micron thick charge transport layer was coated on top of the photogenerating layer from a dispersion prepared from N,N'-diphenyl-N,N-bis(3-methylphenyl)-1,1'-biphenyl-4,4'-diamine (4 grams), a film forming polymer binder PCZ-400 [poly(4,4'-dihydroxy-diphenyl-1-1-cyclohexane, $M_w$=40,000)], available from Mitsubishi Gas Chemical Company, Ltd. (6 grams), and polytetrafluoroethylene, PTFE POLYFLON™ L-2 microparticle, available from Daikin Industries, (1 gram) dissolved/dispersed in a solvent mixture of 21 grams of tetrahydrofuran (THF) and 9 grams of toluene via a CAVIPRO™ 300 nanomizer (Five Star Technology, Cleveland, Ohio) followed by drying in an oven at about 120° C. for about 40 minutes. The charge transport layer PCZ-400/mTBD/PTFE L-2 ratio was 54.5/36.4/9.1.

COMPARATIVE EXAMPLE 3

A photoconductor was prepared by repeating the process of Comparative Example 1 except that the 32 micron thick charge transport layer was coated on top of the photogenerating layer from a solution prepared from N,N'-diphenyl-N,N-bis(3-methylphenyl)-1,1'-biphenyl-4,4'-diamine (4 grams), a film forming polymer binder PCZ-400 [poly(4,4'-dihydroxy-diphenyl-1-1-cyclohexane, $M_w$=40,000)] available from Mitsubishi Gas Chemical Company, Ltd. (6 grams), and the polypropylene glycol dibenzoate (PPG benzoate), available as UNIPLEX® 400 and obtained from Unitex Chemical Corporation with a weight average molecular weight of about 400 as determined by GPC analysis (1 gram), dissolved in a solvent mixture of 21 grams of tetrahydrofuran (THF) and 9 grams of toluene, followed by drying in an oven at about 120° C. for about 40 minutes. The charge transport layer of PCZ-400/mTBD/PPG benzoate UNIPLEX® 400 ratio was 54.5/36.4/9.1.

EXAMPLE I

A photoconductor was prepared by repeating the process of Comparative Example 1 except that the 32 micron thick charge transport layer was coated on top of the photogenerating layer from a dispersion prepared from N,N'-diphenyl-N,N-bis(3-methylphenyl)-1,1'-biphenyl-4,4'-diamine (4 grams), the film forming polymer binder PCZ-400 [poly(4,4'-dihydroxy-diphenyl-1-1-cyclohexane, $M_w$=40,000)], available from Mitsubishi Gas Chemical Company, Ltd. (6 grams), the polypropylene glycol dibenzoate (PPG benzoate), available as UNIPLEX® 400, and obtained from Unitex Chemical Corporation with a weight average molecular weight of about 400 as determined by GPC analysis (1 gram), and polytetrafluoroethylene, PTFE POLYFLON™ L-2 microparticle, available from Daikin Industries (1 gram), dissolved/dispersed in a solvent mixture of 21 grams of tetrahydrofuran (THF) and 9 grams of toluene. The charge transport layer PCZ-400/mTBD/PPG benzoate/PTFE L-2 ratio was about 50/33.3/8.3/8.3.

EXAMPLE II

A photoconductor is prepared by repeating the process of Comparative Example 1 except that the 32 micron thick charge transport layer is coated on top of the photogenerating layer from a dispersion prepared from N,N'-diphenyl-N,N-bis(3-methylphenyl)-1,1'-biphenyl-4,4'-diamine (4 grams), the film forming polymer binder PCZ-400 [poly(4,4'-dihydroxy-diphenyl-1-1-cyclohexane, $M_w$=40,000)], available from Mitsubishi Gas Chemical Company, Ltd. (6 grams), the polypropylene glycol dibenzoate (PPG benzoate), available as UNIPLEX® 988, and obtained from Unitex Chemical Corporation with a weight average molecular weight of about 988 as determined by GPC analysis (1 gram), and polytetrafluoroethylene, PTFE POLYFLON™ L-2 microparticles, available from Daikin Industries (1 gram), dissolved/dispersed in a solvent mixture of 21 grams of tetrahydrofuran (THF) and 9 grams of toluene. The charge transport layer of PCZ-400/mTBD/PPG benzoate/PTFE L-2 ratio is about 50/33.3/8.3/8.3, and is dried at about 120° C. for about 40 minutes.

EXAMPLE III

A photoconductor is prepared by repeating the process of Comparative Example 1 except that the 32 micron charge transport layer is coated on top of the photogenerating layer from a dispersion prepared from N,N'-diphenyl-N,N-bis(3-methylphenyl)-1,1'-biphenyl-4,4'-diamine (4 grams), the film forming polymer binder PCZ-400 [poly(4,4'-dihydroxy-diphenyl-1-1-cyclohexane, $M_w$=40,000)], available from Mitsubishi Gas Chemical Company, Ltd. (6 grams), the polypropylene glycol dibenzoate (PPG benzoate), available as UNIPLEX® 284, and obtained from Unitex Chemical Corporation with a weight average molecular weight of about 284 as determined by GPC analysis (1 gram), and polytetrafluoroethylene, PTFE POLYFLON™ L-2 microparticle available from Daikin Industries (1 gram), dissolved/dispersed in a solvent mixture of 21 grams of tetrahydrofuran (THF) and 9 grams of toluene. The charge transport layer of PCZ-400/mTBD/PPG benzoate/PTFE L-2 ratio is about 50/33.3/8.3/8.3, and is dried at about 120° C.

Electrical Property Testing

The above prepared photoconductors of Comparative Examples 1, 2 and 3, and Example I were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities were measured. Additional electrical characteristics were obtained by a series of charge-erase cycles with incrementing surface potential to generate several voltage versus charge density curves. The scanner was equipped with a scorotron set to a constant voltage charging at various surface potentials. The above photoconductors were tested at surface potentials of 700 volts with the exposure light intensity incrementally increased by means of regulating a series of neutral density filters; and the exposure light source was a 780 nanometer light emitting diode. The xerographic simulation was completed in an environmentally controlled light tight chamber at ambient conditions (40 percent relative humidity and 22° C.).

Substantially similar PIDCs were obtained for the above four photoconductors. Therefore, the incorporation of the above polyalkylene glycol dibenzoate and PTFE into the charge transport layer did not adversely affect the electrical properties of these photoconductors.

Wear Testing

Wear tests of the photoconductors of Comparative Examples 1, 2 and 3, and Example I were performed using an inhouse wear test fixture (biased charging roll, and BCR charging with peak to peak voltage of 1.45 kilovolts). The total thickness of each photoconductor was measured via Permascope before each wear test was initiated. Then the photoconductors were separately placed into the wear fixture for 50 kilocycles. The total photoconductor thickness was measured again with the Permascope, and the difference in thickness was used to calculate wear rate (nanometers/kilocycle) of the photoconductors. The smaller the wear rate, the more wear resistant was the photoconductor. The wear rate data is summarized in Table 1.

TABLE 1

| | Wear Rate (Nanometers/Kilocycle) |
|---|---|
| Comparative Example 1 (No Additive in CTL) | 58 |
| Comparative Example 2 (9.1% of PTFE in CTL) | 31 |
| Comparative Example 3 (9.1% of the PPG Benzoate in CTL) | 65 |
| Example I (8.3% of the PPG Benzoate and 8.3% of PTFE in CTL) | 19 |

Incorporation of the polyalkylene glycol dibenzoate into the charge transport layer (Comparative Example 3) did not reduce the photoconductor wear rate, and, it is believed, increased the wear rate to 65 nanometers/kilocycle for the Comparative Example 3 photoconductor versus 58 nanometers/kilocycle for the Comparative Example 1 photoconductor.

As comparison, the incorporation of PTFE itself into the charge transport layer (Comparative Example 2) reduced the photoconductor wear rate by about 45 percent, 31 nanometers/kilocycle for the Comparative Example 2 photoconductor versus 58 nanometers/kilocycle for the Comparative Example 1 photoconductor.

In embodiments, when both PTFE and the polyalkylene glycol dibenzoate were incorporated into the charge transport layer (Example I), the wear rate was further reduced from that of the PTFE charge transport layer photoconductor (Comparative Example 2) by about 40 percent (19 nanometers/kilocycle for the Example I photoconductor versus 31 nanometers/kilocycle for the Comparative Example 2 photoconductor); and reduced from that of the Comparative Example 1 photoconductor by about 70 percent (19 nanometers/kilocycle for the Example I photoconductor versus 58 nanometers/kilocycle for the Comparative Example 1 photoconductor).

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising a supporting substrate, a photogenerating layer, and a charge transport layer, and wherein said charge transport layer contains a polyalkylene glycol benzoate and a fluorinated polymer.

2. A photoconductor in accordance with claim 1 wherein said polyalkylene glycol benzoate is represented by one of

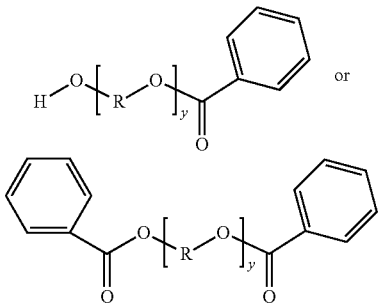

wherein R is an alkylene, and y represents the number units; and said fluorinated polymer is selected from the group consisting of polytetrafluoroethylene, a copolymer of tetrafluoroethylene and hexafluoropropylene, a copolymer of tetrafluoroethylene and perfluoro(propyl vinyl ether), a copolymer of tetrafluoroethylene and perfluoro)ethyl vinyl ether), a copolymer of tetrafluoroethylene, and perfluoro(methyl vinyl ether), a copolymer of tetrafluoroethylene, hexafluoropropylene and vinylidene fluoride, and optionally mixtures thereof.

3. A photoconductor in accordance with claim 2 wherein y is a number between about 2 and about 10, R is ethylene, propylene or butylene, and said fluorinated polymer is a copolymer of tetrafluoroethylene and hexafluoropropylene, or a copolymer of tetrafluoroethylene and perfluoro(propyl vinyl ether).

4. A photoconductor in accordance with claim 2 wherein said alkylene of said polyalkylene glycol benzoate contains from 1 to about 12 carbon atoms, and said charge transport layer is comprised of a hole transport component, a first resin binder, a second resin binder of said polyalkylene glycol benzoate, and said fluorinated polymer.

5. A photoconductor in accordance with claim 2 wherein said alkylene of said polyalkylene glycol benzoate contains from 2 to about 6 carbon atoms, and said charge transport layer is comprised of a hole transport component, a first polycarbonate resin binder, a second resin binder for said polyalkylene glycol benzoate, and said polytetrafluoroethylene in the form of lubricant particles of a diameter of from about 50 to about 3,000 nanometers.

6. A photoconductor in accordance with claim 2 wherein said alkylene of said polyalkylene glycol benzoate is methylene, ethylene, propylene, butylene or pentylene, and said fluorinated polymer is polytetrafluoroethylene of from about 100 to about 1,000 nanometers in diameter.

7. A photoconductor in accordance with claim 1 wherein said polyalkylene glycol benzoate is polypropylene glycol dibenzoate, said fluorinated polymer is polytetrafluoroethylene, and said charge transport layer is comprised of a hole transport component, a first resin binder, and a second resin binder mixture of said polyalkylene glycol benzoate and said fluorinated polymer.

8. A photoconductor in accordance with claim 1 wherein said polyalkylene glycol benzoate possesses a weight average molecular weight of from about 200 to about 2,000, and a number average molecular weight of from about 100 to about 1,000.

9. A photoconductor in accordance with claim 1 wherein said polyalkylene glycol benzoate is present in an amount of from about 0.1 to about 30 weight percent, said alkylene of said polyalkylene glycol benzoate contains from 2 to about 6 carbon atoms, said fluorinated polymer is present in an amount of from about 1 to about 20 weight percent, and said charge transport layer is comprised of a hole transport component, a first resin binder, said fluorinated polymer, and a second resin binder of said poly alkylene glycol benzoate.

10. A photoconductor in accordance with claim 1 wherein said polyalkylene glycol benzoate is a polypropylene glycol dibenzoate present in an amount of from about 1 to about 20 weight percent, and said fluorinated polymer is polytetrafluoroethylene present in an amount of from about 2 to about 15 weight percent.

11. A photoconductor in accordance with claim 1 wherein said charge transport layer is comprised of a first charge transport layer in contact with said photogenerating layer, a second charge transport layer in contact with said first charge transport layer, and wherein said polyalkylene glycol benzoate and said fluorinated polymer are present in at least one of said first and second charge transport layers.

12. A photoconductor in accordance with claim 1 wherein said polyalkylene glycol benzoate is polypropylene glycol dibenzoate present in an amount of from about 3 to about 15 weight percent, and said fluorinated polymer is polytetrafluoroethylene present in an amount of from about 3 to about 10 weight percent.

13. A photoconductor in accordance with claim 1 wherein said polyalkylene glycol benzoate is polypropylene glycol benzoate present in an amount of from about 5 to about 12 weight percent, and said fluorinated polymer is polytetrafluoroethylene present in an amount of from about 4 to about 9 weight percent.

14. A photoconductor in accordance with claim 1 wherein said polyalkylene glycol benzoate is represented by the following formula/structure

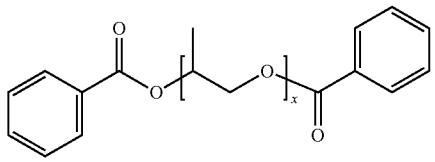

wherein x represents the number of repeating segments of from about 1 to about 20: said fluorinated polymer is selected from the group consisting of polytetrafluoroethylene, a copolymer of a tetrafluoroethylene and hexafluoropropylene, a copolymer of tetrafluoroethylene and perfluoro(propyl vinyl ether), a copolymer of tetrafluoroethylene and perfluoro(methyl vinyl ether), copolymer of tetrafluoroethylene and perfluoro)methyl vinyl ether), and a copolymer of tetrafluoroethylene, hexafluoropropylene and vinylidene fluoride, and said charge transport layer is compromised of a hole transport component, a first resin binder, said fluorinated polymer and a second resin binder of said polyalkylene glycol benzoate, and which photoconductor further contains a hole blocking layer in contract with said substrate and an adhesive layer in contact with said hole blocking layer, and wherein y represents the number of repeating segments and is a number of between about 1 and about 50.

15. A photoconductor in accordance with claim 14 further including a hole blocking layer and an adhesive layer, and said first resin binder is a polycarbonate, and wherein said polyalkylene glycol benzoate is present in an amount of from about 3 to about 12 percent, and wherein x is from about 2 to about 10.

16. A photoconductor in accordance with claim 15 wherein the ratio of said polycarbonate to said hole transport component to said polypropylene glycol dibenzoate to said fluorinated polymer is about 50/33.3/8.3/8.3.

17. A photoconductor in accordance with claim 1 wherein said charge transport layer is comprised of first resin binder, a second resin binder of said polyalkylene glycol benzoate, and said fluorinated polymer of a polytetrafluoroethylene and a component as a represented by at least one of

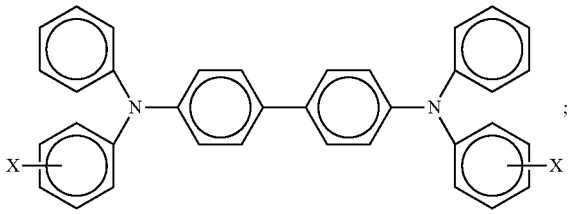

;

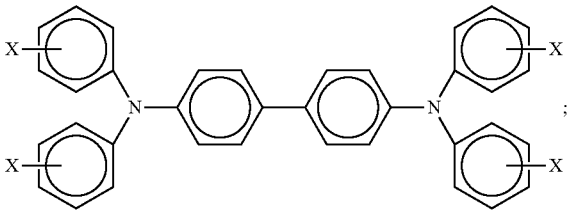

;

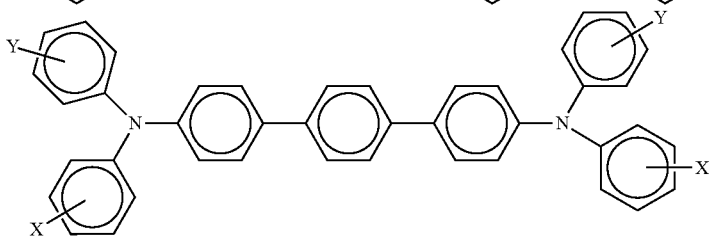

and

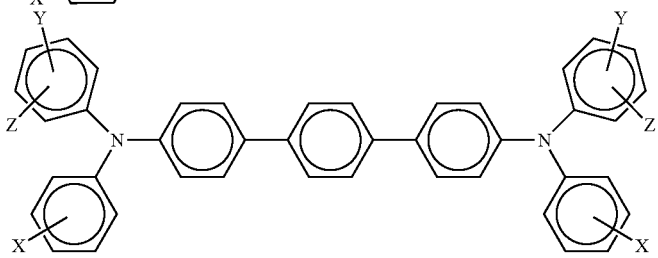

wherein X, Y, and Z are independently selected from the group consisting of alkyl, alkoxy, aryl, halogen, and mixtures thereof.

18. A photoconductor in accordance with claim 1 wherein said charge transport layer is comprised of a first polycarbonate resin binder, said polyalkylene glycol benzoate, said fluorinated polymer functioning primarily as a lubricant, and a component selected from the group consisting of N,N'-bis(methylphenyl)-1,1-biphenyl-4,4'-diamine, tetra-p-totyl-biphenyl-4,4'-diamine, N,N'-diphenyl-N,N'-bis(4-methoxyphenyl)-1,1-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]4,4"-diamine, N,N'-bis(4-butylphenyl)-N,N'-di-o-tolyl-[p-terphenyl]-4,4"-diamine, N,N'-bis(4-butylphenyl)-N,N'-bis(4-isopropylphenyl)-[p-terpheyl]-4,4"-diamine, N,N'-bis(4-butylphenyl)-N,N'-bis-(2-ethyl-6-methylphenyl)-[p-terphenyl]-4,4"-diamine, N,N'-bis(4butylphenyl)-N,N'-bis(2,5-dimethylphenyl)-[p-terphenyl]4,4"-diamine, and N,N'-diphenyl-N,N'-bis(3chlorophenyl)-[p-terphenyl]-4,4"-diamine, and optionally wherein said polyalkylene benzoate is a polypropylene glycol dibenzoate.

19. A photoconductor in accordance with claim 1 wherein said photogenerating layer is comprised of at least one photogenerating pigment.

20. A photoconductor in accordance with claim 19 wherein said photogenerating pigment is comprised of at least one of a titanyl phthalocyanine, a hydroxygallium phthalocyanine, a halogallium phthaiocyanine, a bisperylene, and mixtures thereof.

21. A photoconductor in accordance with claim 1 wherein said charge transport layer is comprised of a charge transport component, a first polycarbonate resin binder, and a second resin binder of said polyalkylene glycol benzoate, and wherein said alkylene contains from 2 to about 6 carbon atoms, and said fluorinated polymer is selected from the group consisting of polytetrafluoroethylene, a copolymer of tetrafluoroethylene and hexafluoropropylene, a copolymer of tetrafluoroethylene and perfluoro(propyl vinyl ether), a copolymer of tetrafluoroethylene and perfluoro(ethyl vinyl ether), a copolymer of tetrafluoroethylene and perfluoro(methyl vinyl ether), and a copolymer of tetrafluoroethylene, hexafluoropropylene and vinylidene fluoride, and wherein said photogenerating layer is compromised of at least one photogenerating pigment and a resin binder; and wherein said photogenerating layer is situated between said substrate and said charge transport layer.

22. A photoconductor in accordance with claim 1 further including in said charge transport layer an antioxidant comprised of at least one of a hindered phenolic and a hindered amine.

23. A photoconductor in accordance with claim 1 further including a hole blocking layer, and an adhesive layer, wherein the hole blocking layer is in the form of a coating in contact with the supporting substrate, and the adhesive layer is in the form of a coating in contact with the hole blocking layer.

24. A photoconductor in accordance with claim 1 further including a hole blocking layer and an adhesive layer, and wherein said charge transport layer contains a charge transport component, a polycarbonate resin binder, said fluorinated polymer is polytetrafluoroethylene, and wherein said polyalkylene glycol benzoate is polypropylene glycol dibenzoate present in an amount of from about 3 to about 12 weight percent.

25. A photoconductor comprised of a supporting substrate, a hole blocking layer thereover, a photogenerating layer, and a charge transport layer, and wherein said charge transport layer contains a polyalkylene glycol benzoate present in an amount of from about 1 to about 12 weight percent, and a polytetrafluoroethylene present in an amount of from about 2 to about 10 weight percent.

26. A photoconductor in accordance with claim 25 wherein said hole blocking layer is compromised of an aminosilane of at least one of 3-aminopropyl triethoxysilane, N,N-dimethyl-3-aminopropyl triethoxysilane, N-phenylaminopropyl trimethoxysilane, triethoxysilypropylethylene dimaine, trimethoxysilylpropylethylene diamine, trimethoxysilypropylidiethylene triamine, N-aminoethyl-3-aminopropyl trimethoxysilane, N-2-aminoethyl-3-aminopropyl trimethoxysilane, N-2-aminoethyl-3aminopropyl tris (ethylethoxy)silane, p-aminophenyl trimethoxysilane, N,N'-dimethyl-3-aminopropyl triethoxysilane, 3-aminopropylmethyl diethoxysilane, 3-aminopropyl trimethoxysilane, N-methylaminopropyl triethoxysilane, methyl[2-(3-trimethyloxysilylpropylamino)ethylamino]-3-proprionate, (N,N'-dimethyl3-amino)propyl triethoxysilane, N,N-dimethylaminophenyl triethoxysilane, trimethoxysilyl propyldiethylene triamine, and mixtures thereof.

27. A photoconductor in accordance with claim 25 wherein said hole blocking layer is comprised of an aminosilane represented by

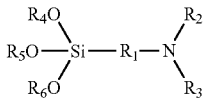

wherein $R_8$ is an alkylene; $R_2$ and $R_3$ are alkyl, hydrogen, or aryl, and each $R_4$, $R_5$ and $R_6$ is alkyl.

28. A photoconductor in accordance with claim 25 wherein said polyalkylene glycol benzoate is present in an amount of from about 5 to about 10 weight percent, and said polytetrafluoroethylene is present in an amount of from about 3 to about 8 weight percent.

29. A photoconductor in accordance with claim 25 wherein said polyalkylene glycol benzoate is an polypropylene glycol dibenzoate present in an amount of from about 3 to about 15 weight percent and further containing in said charge transport layer of a polycarbonate.

30. A photoconductor comprised in sequence of a photogenerating layer comprised of a photogenerating pigment, a hole blocking layer, an adhesive layer, and a charge transport layer, and wherein said charge transport layer is comprised of a charge transport component, a resin binder, a polyalkylene glycol benzoate and a fluorinated polymer selected from the group consisting of polytetrafluoroethylene, and copolymer of tetrafluoroethylene and hexafluoropropylene, a copolymer of tetrafluoroethylene and perfluoro(propyl vinyl ether), a copolymer of tetrafluoroethylene and perfluoro(ethyl vinyl ether), a copolymer of tetrafluoroethylene and perfluoro(methyl vinyl ether), and a copolymer of tetrafluoroethylene, hexafluoropropylene and vinylidene fluoride.

31. A photoconductor in accordance with claim 30 wherein said polyalkylene glycol benzoate is a polypropylene glycol dibenzoate or a polybutylene glycol benzoate each present in an amount of from about 1 to about 12 weight percent, said resin binder is a polycarbonate, and said fluorinated polymer is a polytetrafluoroethylene.

32. A photoconductor in accordance with claim 31 wherein said polypropylene glycol dibenzoate is present in an amount of from about 3 to about 10 weight percent, said polycarbonate is present in an amount of from about 40 to about 70 weight percent, and said polytetrafluoroethylene is present in an amount of from about 2 to about 10 weight percent.

* * * * *